United States Patent [19]

Kohara et al.

[11] 4,196,684

[45] Apr. 8, 1980

[54] SHUTTLE DEVICE FOR SEWING MACHINE

[75] Inventors: Tadao Kohara; Hiroshi Tano, both of Osaka, Japan

[73] Assignee: Maruzen Sewing Machine Co., Ltd., Moriguchi, Japan

[21] Appl. No.: 912,483

[22] Filed: Jun. 5, 1978

[30] Foreign Application Priority Data

Jun. 21, 1977 [JP] Japan ..... 52/82076[U]
Jul. 18, 1977 [JP] Japan ..... 52/96206[U]

[51] Int. Cl.[2] ..... D05B 57/14
[52] U.S. Cl. ..... 112/184; 112/231
[58] Field of Search ..... 112/184, 191, 228, 231

[56] References Cited

U.S. PATENT DOCUMENTS

| | | | |
|---|---|---|---|
| 1,917,771 | 7/1933 | Myers | 112/184 X |
| 3,115,855 | 12/1963 | Ketterer | 112/184 |
| 3,217,678 | 11/1965 | Fresard | 112/184 |
| 3,921,551 | 11/1975 | Gustmann et al. | 112/228 X |
| 4,108,095 | 8/1978 | Kohara | 112/184 |

*Primary Examiner*—Wm. Carter Reynolds
*Attorney, Agent, or Firm*—Arnstein, Gluck, Weitzenfeld & Minow

[57] ABSTRACT

A shuttle device provided with a rotating hook comprises a rotatable race secured to a verticle driving shaft. A bobbin carrier is journalled in the race and has a pair of spaced abutment faces on opposite sides of the path of the needle. The abutment faces cooperate with two spaced beaks on an oscillating escapement so that one of the beaks is always in contact with one of the abutment faces to prevent the carrier from rotating. The oscillation of the escapement permits a space to be left alternatively for each pair of cooperating beaks and abutment faces for the passage of the upper thread loop. The escapement is resiliently yieldable to prevent injury to the beaks or abutment faces, in the event of thread jamming between the sliding contact faces of the shuttle race and the bobbin carrier.

3 Claims, 13 Drawing Figures

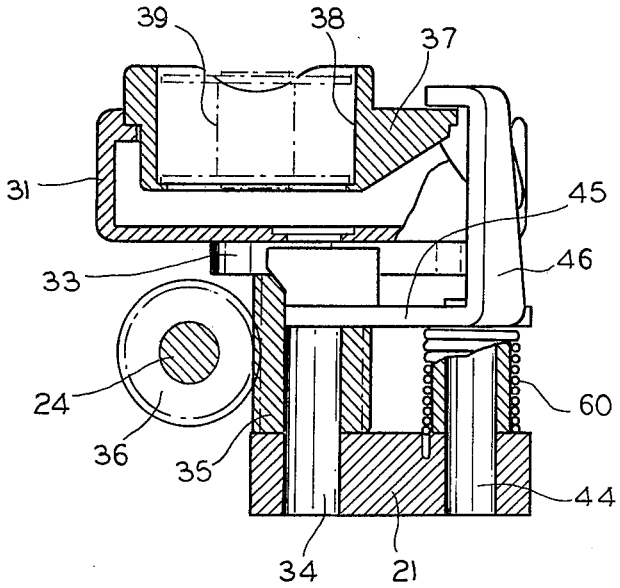
FIG. 9
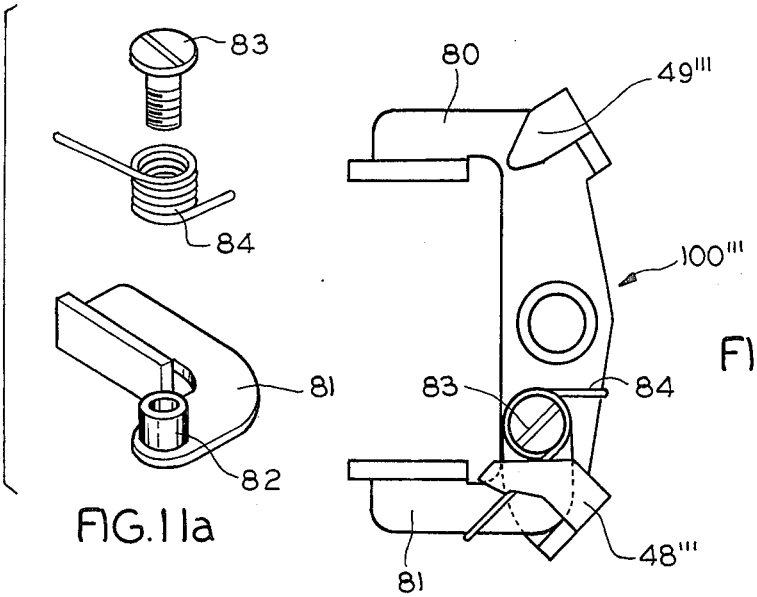
FIG. 11a
FIG. 11

SHUTTLE DEVICE FOR SEWING MACHINE

BACKGROUND OF THE INVENTION

The present invention relates to a shuttle device having a rotating hook for a sewing machine.

Shuttle devices having rotating hooks provided with an abutment mechanism utilizing an escapement oscillating under the action of a rotatable cam are well known. U.S. Pat. No. 3,217,678 discloses such a device which comprises a vertical shaft, a rotatable casing having a hook formed on the edge of the casing wall and rotatable on said shaft, a cam secured to the underside of said casing, a bobbin carrier rotatably supported in said casing, the carrier having on its upper surface a pair of spaced abutment faces, an escapement mounted for oscillation about an axis parallel to the shaft, the escapement having a pair of beaks cooperating with said abutment faces so that one beak is always in contact with a respective abutment face in order to prevent rotation of the bobbin carrier. In the course of operation alternate gaps are formed between cooperating beaks and abutments for the passage of the upper thread loop.

It has been found that such devices are prone to clogging or jamming when a part of a thread loop is caught between the engaging faces of the rotatable casing and the bobbin carrier. When such jamming occurs the bobbin carrier and outer casing are jammed together forcing the bobbin carrier to rotate with the outer casing which may result in deformation or injury to the beaks and other parts of the device.

SUMMARY OF THE INVENTION

One of the objects of this invention is the provision, in a shuttle device of the type described, of means for releasing the escapement from under the influence of the rotary cam, in the event of clogging or jamming of the rotatable casing and bobbin carrier, so as to prevent injury to the beaks or cooperating abutment faces.

Another object of this invention is the provision of resilient yieldable means associated with the escapement to absorb any forces between engaging faces of the beaks and abutment faces, in the event of jamming of the parts, thereby to avoid injury to or deformation of the parts.

Still another object of this invention is the provision of an escapement formed of two parts relatively movable to each other and interconnected by a spring so that one part is yieldable relative to the other, thereby to avoid injury to the beaks constituting a part of the escapement, in the event jamming of the parts by a thread caught between the rotatable casing and the bobbin carrier.

Other and further objects and advantages of this invention will become apparent from the following description when the same is considered in connection with the accompanying drawings.

BRIEF DESCRIPTION OF THE DRAWINGS

FIG. 9 is an elevational view, partly in cross section, illustrating the embodiment shown in FIGS. 7 and 8.

FIG. 11 is a top plan view of still another modified embodiment of escapement; and FIG. 11A is an exploded perspective view of details included in the embodiment illustrated in FIG. 11.

BRIEF DESCRIPTION OF PREFERRED EMBODIMENTS

Figure 1:
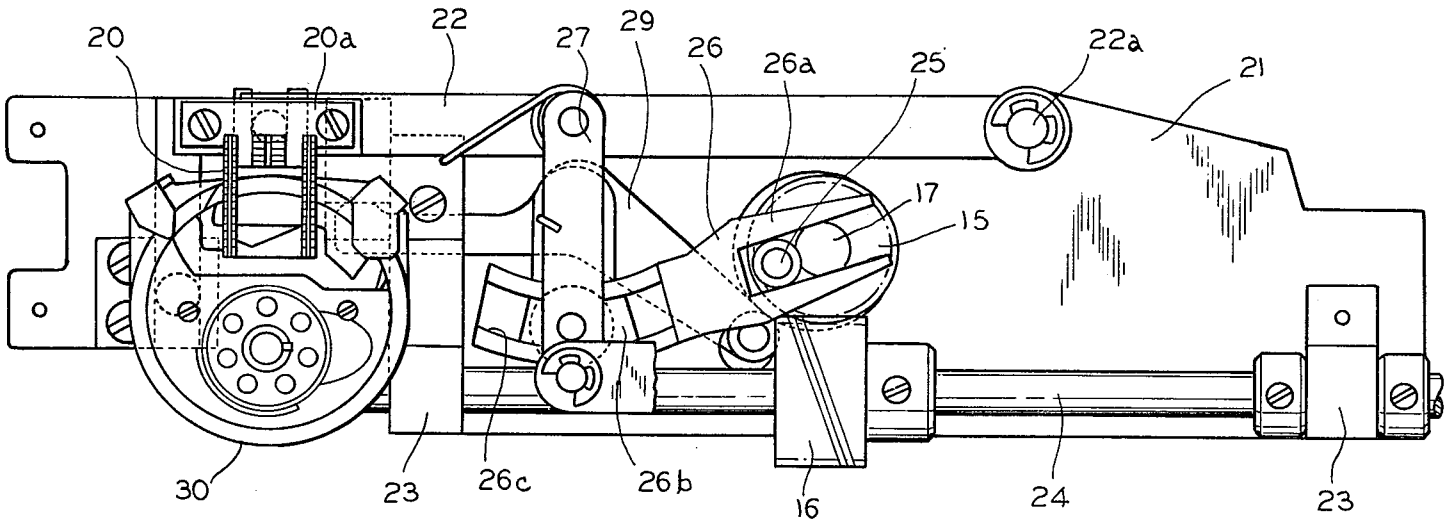
FIG. 1 is a top plan view of the mechanism in the base or lower arm of a sewing machine in which the present invention is embodied.

Referring to FIG. 1, the present invention, as illustrated in the drawings, is intended for use with a vertical axis rotary shuttle and is embodied in a sewing machine which includes in the work arm, a base member 21 having a rotary shaft 24 journalled in bearing members 23 supported on the base member. In the usual manner the shaft 24 is designed to actuate the shuttle and feed lift mechanism, hereinafter to be described, and is itself driven by any suitable means, not shown.

A rotary member 15 which includes a helical gear is rotably supported on a shaft 17 secured in the base member 21. The helical gear cooperates with a worm wheel 16 affixed on drive shaft 24. The rotary member 15 carries on its upper surface a roller 25 disposed eccentric to the axis of shaft 17. A slide block guide 26 is supported on a vertical shaft, not shown, fixed in the base 21. The block guide 26 includes an integral forked portion **26*a* which embraces roller 25. Rotation of the rotary member 15 will effect rocking of the block guide 26 about the axis of its vertical shaft. A lever 22 is rockably supported on a shaft 22*a* fixed on the base plate 21 and a connecting bar 27 is connected at one end to an intermediate point of lever 22. The opposite end of the connecting bar 27 is connected to a slide block 26*b* slidably received in an arcuate guideway 26*c* of block guide 26**.

A feed dog 20 is mounted on a feed dog support **20*a* which is actuated in a horizontal direction by lever 22. It will be understood that rotation of the rotary member 15 will effect rocking of the block guide 26 and transmit such motion to lever 22 to effect reciprocatory horizontal movement of the feed dog 20**.

The foregoing construction and its operation is more fully disclosed in U.S. Pat. No. 4,074,644 and forms no part of the present invention.

The shuttle and bobbin carrier constituting the present invention is illustrated more clearly in FIGS. 2–5 and includes a cup-shaped shuttle casing 31 having an integral hook 32. The shuttle casing 31 is supported on a vertical shaft 34 fixed in the base 21. A helical gear **34*a* is rotatably mounted on shaft 34 and cooperates with a worm wheel 36 fixed on shaft 24 which when rotated will effect rotation of the shuttle casing 31 about the axis of shaft 34. Fixed to the underside of the shuttle casing 31 is an eccentric cam 33, the cam being mounted on shaft 34. The shaft 34** is disposed in parallel relation with the needle (not shown) and the shuttle casing rotates in a plane normal to the needle.

Received within the cavity of the shuttle casing 31 is a bobbin carrier 37 provided with a circular bore to receive a bobbin 39. The upper surface of the carrier is smooth and without any sharp edges so as to facilitate movement of the upper thread over the surface of the carrier. The carrier 37 is securely retained within the cavity of the shuttle casing 31 and is freely rotatable relative thereto.

A vertical shaft 44 is secured in the base 21 in parallel relation to the shaft 34. An escapement, indicated generally by the numeral 100, provided with a depending collar 101 is rockably supported on shaft 44. The escapement 100 is formed of two members 45 and 50, with the member 50 being superposed on the member 45 and secured together for relative movement as by the enlarged head of shaft 44. Member 45 includes a horizontal portion 45*a* and a pair of integral spaced upstanding arms 45*b* and 45*c* which terminate in inwardly bent horizontal beaks 48 and 49, respectively.

Figure 6:
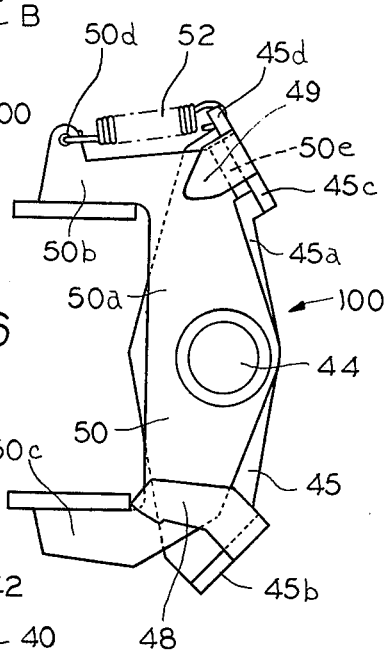
FIG. 6 is a top plan view of the escapement embodying the present invention.

Member 50 includes a horizontal portion 50*a* having a pair of flanged arms 50*b* and 50*c* constituting a fork arranged to embrace the cam 33 secured to the underside of the shuttle casing 31. Members 45 and 50 are provided with integral pierced lugs 45*d* and 50*d* respectively, between which is stretched a coil spring 52. The horizontal portion 50*a* is provided with an upstanding lug 50*e* constituting a stop which is substantially in registration with the upstanding arm 45*c* of member 45. The spring 52 normally biases the members 45 and 50 towards each other, as viewed in FIG. 6, so that arm 45*c* normally is in engagement with the lug 50*e*. It will be apparent that the members 45 and 50 while maintained by the spring 52 in firm secure relation are relatively movable, as will be hereinafter more fully explained.

Figure 2:
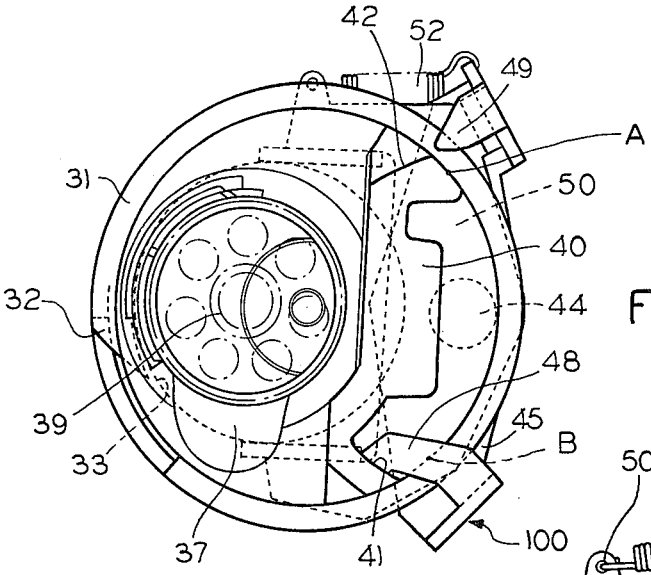
FIG. 2 is a top plan view, on an enlarged scale, of the shuttle device shown in FIG. 1.
Figure 3:
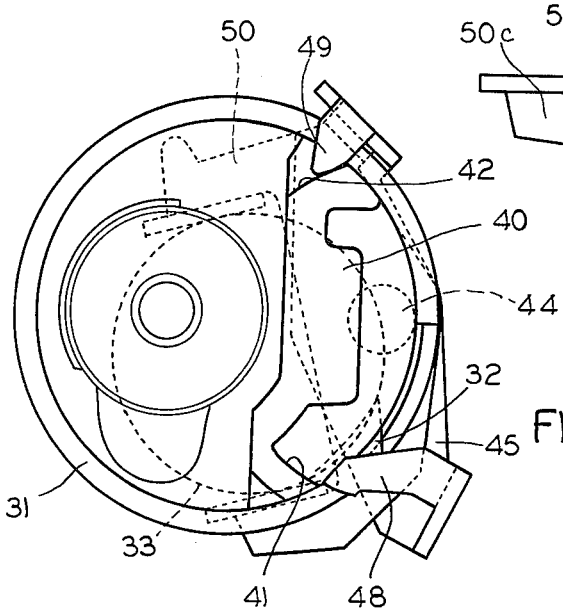
FIG. 3 is a view similar to FIG. 2, but showing the parts of the shuttle device in a different operating relationship.
Figure 5:
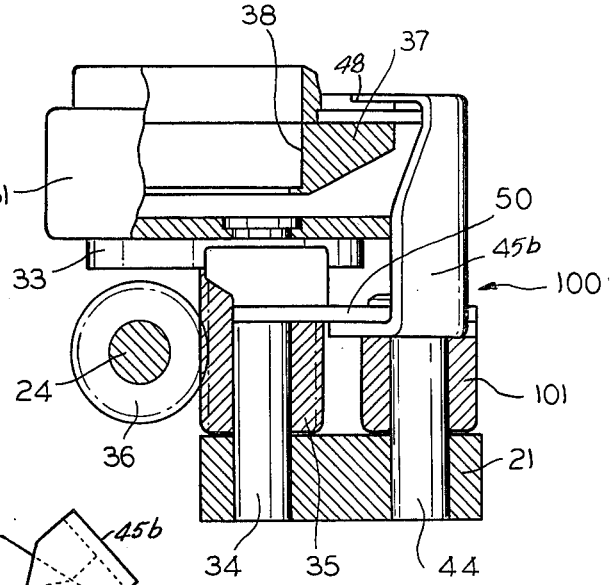
FIG. 5 is an elevational view, partly in cross section, of the shuttle device illustrated in FIGS. 2–4.
Figure 4:
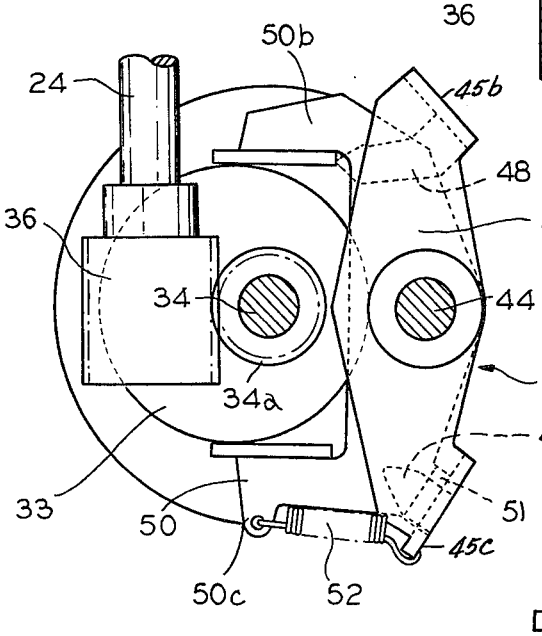
FIG. 4 is a bottom plan view of the shuttle device illustrated in FIG. 2.

Secured to the upper surface of the bobbin carrier 37 is a plate member 40, shaped substantially as illustrated in FIGS. 2 and 3, and including two abutment faces 41 and 42, the curvature of face 41 being concave while the curvature of face 42 is convex. The beaks 48 and 49 are correspondingly shaped, each having an edge face complementary to a respective abutment face so that each edge face will slide smoothly against a cooperating abutment face in operation.

In the operation of the mechanism above described, the shuttle casing 31 makes two complete revolutions for each stitch or entry of the needle, not shown, into the fabric. The hook 32 functions to catch a loop formed by the upper thread, not shown, and to pass it around the bobbin 39. If the bobbin carrier 37 were not restrained, in the manner hereinabelow described, it would be carried along with the rotatable shuttle casing 31.

Cam 33 effects oscillating movement of the escapement 100 about shaft 44. In such movement when the hook 32 reaches the position shown in FIG. 3, the beak 48 has moved to its maximum distance away from the abutment face 41 affording maximum clearance between the abutment face 41 and beak 48 for the passage of a thread therethrough, to allow the thread to begin to move around the bobbin carrier 37. As seen in FIG. 3, at this point beak 49 is in its position of maximum engagement with abutment face 42 which serves to prevent rotation of the bobbin carrier 37. As hook 32 continues to rotate counterclockwise, escapement 100 is caused to rock clockwise, so that when hook 32 is disposed adjacent abutment face 42 beak 49 has moved away from abutment face 42 a maximum distance to provide a space for the passage of the thread loop therethrough. Correspondingly, beak 48 has moved into a position of maximum engagement with abutment face 41, as viewed in FIG. 2. In the course of rotation of shuttle casing 31 at least one of the beaks 48, 49 is always in engagement with a respective abutment face 41, 42 thereby preventing rotation of the bobbin carrier 37 which remains in fixed position.

Generally, a malfunction may occur as the upper thread loop, not shown, is being drawn out by the hook 32 or drawn up by the take-up lever, not shown, and a portion of said loop is caused to be jammed between the sliding interfaces of the bobbin carrier 37 and the shuttle casing 31. This may occur between points A and B noted in FIG. 2 and, as the hook 32 continues to engage the upper thread loop, more thread portions may be jammed in between the interfaces creating a large frictional drag or torque effect on the bobbin carrier 37.

Referring to FIG. 2, when the parts are in the relationship illustrated wherein the abutment face 41 and beak 48 are engaged, if jamming occurs an excessive force acts on the beak 48 which is engaged with the abutment face 41 tending to rotate the escapement mechanism 100 counterclockwise, as viewed in FIG. 2. However, rotation of the escapement 100 is blocked by the abutment stop 50*e* thereby causing the beak 48 and abutment face 41 to be locked together. However, because the shuttle casing 31 continues to rotate against the frictional drag on the bobbin carrier 37, escapement member 50 which engages the cam 33 also rocks in a counterclockwise direction about the axis of shaft 44, as viewed in FIG. 2. While the beak 48 and abutment face 41 are in locked condition, as above described, the member 50 may move relative to the other member 45 against the tension of spring 52 which acts in the nature of a shock absorber. Thus, stresses between the beak 48 and its abutment face 41 are relieved and injury to the beak 48 is avoided.

If jamming should occur while the beak 49 and abutment face 42 and in engagement, as seen in FIG. 3, an excessive force acts on the beak 49 and, under such circumstances, the beak 49 could be deformed or otherwise injured. However, under such conditions the member 45 will be caused to rock in a clockwise direction, as viewed in FIG. 3, against the tension of the spring 52 thereby effecting separation of the beak 49 from its associated abutment face 42 and effecting engagement of the beak 48 with its associated abutment face 41. Thus, the normal relationship between the cam 33 and the beaks 48 and 49 and their associated abutment faces 41 and 42 are temporarily altered, thereby avoiding injury to either of the beaks. Of course, when the jamming or clogging thread is removed from between the bobbin carrier 37 and the shuttle casing 31 normal operation of the parts is resumed.

In the modified embodiment illustrated in FIGS. 7–11 identical reference numerals will be utilized to identify identical parts and corresponding primed numerals will be used to identify corresponding parts.

Figure 7:
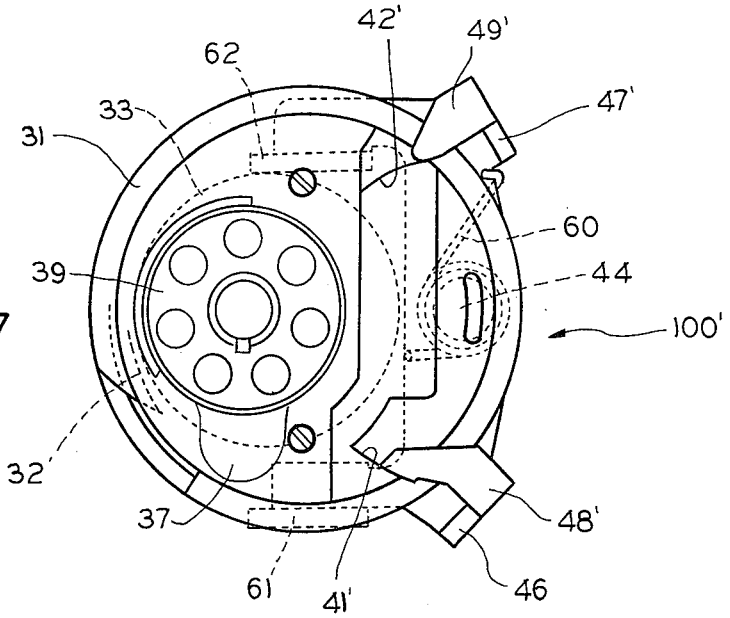
FIG. 7 is a top plan view, similar to FIG. 2, illustrating a modified embodiment of the present invention.
Figure 8:
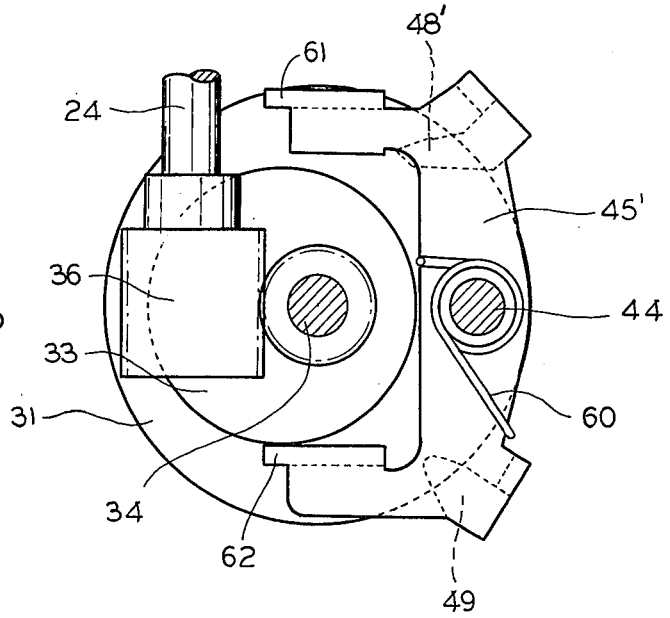
FIG. 8 is a bottom plan view of the shuttle device illustrated in FIG. 7.

Referring to FIGS. 7–9 a unitary escapement 100′ is mounted for swinging movement on shaft 44. The escapement 100′ includes beaks 48′ and 49′ and a forked lower portion having flanged arms 61 and 62 which embrace the cam 33. As seen in FIG. 8 the spacing between the flanges of arms 61 and 62 is greater than the largest dimension of the cam 33. A torsion spring 60 is circumposed about the shaft 44 and has one end anchored in the base 21 and the other end hooked onto the body of escapement 100'. Thus, the escapement is biased to rotate in a clockwise direction, as viewed in FIG. 8, thereby to maintain the flange of arm 62 in engagement with the cam 33, while the opposite flange of arm 61 is normally disposed in spaced relation to the cam 33.

In the operation of this modified embodiment, if jamming occurs while the beak 48' and abutment 41' are engaged, the beak 48' is subjected to increased pressure by the abutment face 41' which tends to rotate the escapement 100' counterclockwise, as viewed in FIG. 7. However, because the flange of arm 62 is engaged with the cam, escapement 100' cannot rotate, thus the beak 48' and abutment face 41' are locked together. As the shuttle casing 31 continues to rotate, the escapement 100' is caused to rock about the axis of shaft 44 in a clockwise direction as viewed in FIG. 7, against the torque of the spring 60 so that the flange of arm 62 is spaced from the periphery of cam 33 while the flange of arm 61 contacts the periphery of the cam 33. Thus, the engagement 100' is effectively disengaged from the cam 33 so as not to be influenced thereby. If thread jamming occurs while the beak 49' and abutment face 42' are in engagement, the escapement 100' is caused to rotate clockwise, as viewed in FIG. 7, against the torsion of the spring 60 and the beak 48' and abutment face 41' are caused to be engaged and maintained in such relationship. Thus, it can be seen that stress on the beak 49' is relieved so as to avoid injury thereto.

Figure 10A:
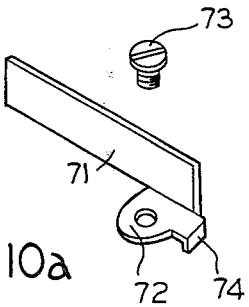
FIG. 10A is an exploded perspective view of details included in the embodiment illustrated in FIG. 10.
Figure 10:
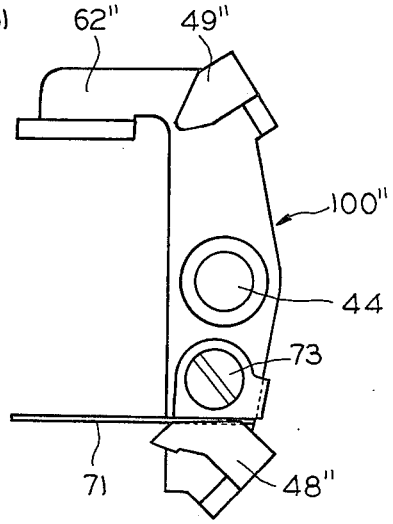
FIG. 10 is a top plan view of another modified embodiment of the escapement.

In another modified embodiment illustrated in FIG. 10 a unitary escapement 100'' is provided, but in this instance, one of the arms of the escapement is eliminated and a leaf spring arm 71 is provided in place thereof. The leaf spring arm 71 includes a mounting flange 72 having a hole to receive a screw 73 which secures the leaf spring to the body of the escapement 100''. The flange 72 is provided with a depending lug 74 which is adapted to engage the edge of the escapement body so as to prevent relative movement. The spacing between the leaf spring 71 and flange of arm 62'' is substantially identical to the spacing between the flanges **50*b* and 50*c* shown in FIG. 6 so that the flange 62'' and leaf spring arm 71 engage opposite sides of the cam 33**.

In the event of jamming of the shuttle casing 31 and bobbin carrier 37 the beak 48'' is locked into engagement with the corresponding abutment face and, under such conditions, is subjected to excessive stresses. However, at this point the leaf spring arm 71 is engaged with a high point of the cam 33 and will bend and relieve the stresses on the beak 48'' while this beak and associated abutment face are in engaged relation.

FIG. 11 illustrates still another modified embodiment of the present invention in which the escapement 100''' is provided with a rigid arm 81 substituted for the leaf spring arm 71 of the embodiment illustrated in FIG. 10. As seen in FIGS. 11 and **11*a*, the arm 81 is shaped, as illustrated, and includes a bushing 82 supported on a stud 83 carried on the escapement body. A torsion spring 84 is circumposed about the bushing 82 and normally biases the member 81 in a clockwise direction, as viewed in FIG. 11, so that the arm 81 as well as the arm 80 are always in contact with the cam 33**.

The operation of the arm 81 is substantially identical to that of the leaf spring arm 71 shown in FIG. 10 and hereinabove described. As should be apparent arm 81 will yield in the event of excessive stresses being applied to the beak 48'''.

Various changes coming within the spirit of my invention may suggest themselves to those skilled in the art; hence, I do not with to be limited to the specific embodiments shown and described or uses mentioned, but intend the same to be merely exemplary, the scope of my invention being limited only by the appended claims.

We claim:

1. In a sewing machine, a shuttle device, comprising a vertical shaft, a rotatable casing having a hook formed on an edge of the casing wall and rotatable on said shaft, a cam secured to the underside of said casing, a bobbin carrier supported in said casing for relative movement, said carrier having on its upper surface a pair of spaced abutment faces, escapement means mounted for oscillation about an axis parallel to said shaft, said escapement means including relatively movable first and second members, the first member having a forked portion embracing the cam and the second member having two spaced beaks, means for driving said cam to impart oscillating motion to said escapement means, each of said beaks cooperating with a respective abutment face in such a manner that one of said beaks is always in contact with a respective one of said abutment faces, the oscillation of said escapement means permitting a space to be left alternatively between a beak and a cooperating abutment face for the passage of a thread loop, a spring connected between said first and second members to allow the release of said escapement means from the effect of said cam when either one of said beaks and a cooperating abutment face is in a jamming relation due to the presence of a thread portion between the casing and the bobbin carrier thereby to avoid injury to said beaks or abutment faces.

2. In a sewing machine, a shuttle device, comprising a vertical shaft, a rotatable casing having a hook formed on an edge of the casing wall and rotatable on said shaft, a cam secured to the underside of said casing, a bobbin carrier supported in said casing for relative movement, said carrier having on its upper surface a pair of spaced abutment faces, escapement means mounted for oscillation about an axis parallel to said shaft, said escapement means including relatively movable first and second members, said first member having a first horizontal part including a forked portion embracing the cam, said second member having a second horizontal part and a pair of spaced upstanding arms each terminating in a beak, said first horizontal part being superimposed on said second horizontal part, each of said beaks cooperating with a respective abutment face in such a manner that one of said beaks is always in contact with a respective one of said abutment faces, the oscillation of said escapement means permitting a space to be left alternatively between a beak and a cooperating abutment face for the passage of a thread loop, a spring connected between said first and second members to allow release of said escapement means from the effect of said cam when either one of said beaks and a cooperating abutment face is in a jamming relation due to the presence of a thread portion between the casing and the bobbin carrier thereby to avoid injury to said beaks or abutment faces.

3. The invention as defined in claim 2 including an abutment stop, on one of said members for limiting the relative movement of the movable members under the influence of the spring.

* * * * *